US008926050B2

(12) United States Patent
Maeyama

(10) Patent No.: US 8,926,050 B2
(45) Date of Patent: Jan. 6, 2015

(54) IMAGE FORMING APPARATUS

(71) Applicant: Yuichiro Maeyama, Kanagawa (JP)

(72) Inventor: Yuichiro Maeyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/083,635

(22) Filed: Nov. 19, 2013

(65) Prior Publication Data

US 2014/0146106 A1 May 29, 2014

(30) Foreign Application Priority Data

Nov. 26, 2012 (JP) ..... 2012-257999

(51) Int. Cl.
*B41J 29/38* (2006.01)
*B41J 11/00* (2006.01)
*B41J 15/04* (2006.01)

(52) U.S. Cl.
CPC ..... *B41J 11/0085* (2013.01); *B41J 15/04* (2013.01)
USPC ..... 347/16

(58) Field of Classification Search
CPC ..... B41J 3/543; B41J 15/16; B41J 11/0095; B41J 11/0085; B41J 11/007; B41J 13/226
USPC ..... 347/16, 101, 102, 104
See application file for complete search history.

(56) References Cited

U.S. PATENT DOCUMENTS

| | | | | |
|---|---|---|---|---|
| 6,981,766 | B2 * | 1/2006 | Tsuji | 347/104 |
| 8,132,883 | B2 | 3/2012 | Niihara et al. | |
| 8,167,307 | B2 | 5/2012 | Maeyama et al. | |
| 2013/0240593 | A1 | 9/2013 | Maeyama | |

FOREIGN PATENT DOCUMENTS

| | | |
|---|---|---|
| JP | 2011-056694 | 3/2011 |

* cited by examiner

*Primary Examiner* — An Do
(74) *Attorney, Agent, or Firm* — Cooper & Dunham LLP

(57) ABSTRACT

An image forming apparatus includes a carriage in which recording heads including nozzles for jetting liquid droplets are mounted; and a conveying unit configured to convey a recording medium facing the recording heads. The recording heads include a first recording head and a second recording head having a wider printing width than that of the first recording head. The conveying unit includes a guide member configured to guide the recording medium facing the recording heads. Recessed shape parts arranged in at least a medium conveying direction are formed in the guide member. The recording medium can be suctioned by generating negative pressure at the recessed shape parts. A partition wall part between the recessed shape parts is provided at a position corresponding to a downstream side edge in the medium conveying direction of the first recording head.

5 Claims, 14 Drawing Sheets

IMAGE FORMING APPARATUS

BACKGROUND OF THE INVENTION

1. Field of the Invention

The present invention relates to an image forming apparatus.

2. Description of the Related Art

As image forming apparatuses such as a printer, a fax machine, a copier, a plotter, and a multifunction peripheral including these functions, there is known, for example, an inkjet recording device as an image forming apparatus of a liquid jetting recording method using liquid jetting heads (liquid droplet jetting heads) for jetting liquid droplets, as recording heads.

As such an image forming apparatus, there is known an example of conveying a sheet which is a recording medium by suctioning the sheet, by air suction, to a guide member (also referred to as a "platen member") for guiding sheets.

Conventionally, there is known a technology of forming a plurality of suction areas created by dividing the area in the sheet conveying direction or the width direction of the sheet, and suctioning areas according to the size and the position of the sheet (Patent Document 1).

Patent Document 1: Japanese Laid-Open Patent Publication No. 2011-056694

Incidentally, there is known an image forming apparatus including, for example, black heads for monochrome printing and color heads for color printing as recording heads, in which the printing width of the black heads is wider than that of the color heads.

In an image forming apparatus having such a head configuration, there is a need to convey the sheet by suctioning the sheet with an appropriate suction force, both in the case of monochrome printing and color printing.

SUMMARY OF THE INVENTION

The present invention provides an image forming apparatus, in which one or more of the above-described disadvantages are eliminated.

According to an aspect of the present invention, there is provided an image forming apparatus including a carriage in which a plurality of recording heads including nozzles for jetting liquid droplets are mounted; and a conveying unit configured to convey a recording medium facing the plurality of recording heads, wherein the plurality of recording heads include a first recording head and a second recording head having a wider printing width than that of the first recording head, the conveying unit includes a guide member configured to guide the recording medium facing the plurality of recording heads, a plurality of recessed shape parts arranged in at least a medium conveying direction are formed in the guide member, the recording medium can be suctioned by generating negative pressure at the plurality of recessed shape parts, and a partition wall part between the plurality of recessed shape parts is provided at a position corresponding to a downstream side edge in the medium conveying direction of the first recording head.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
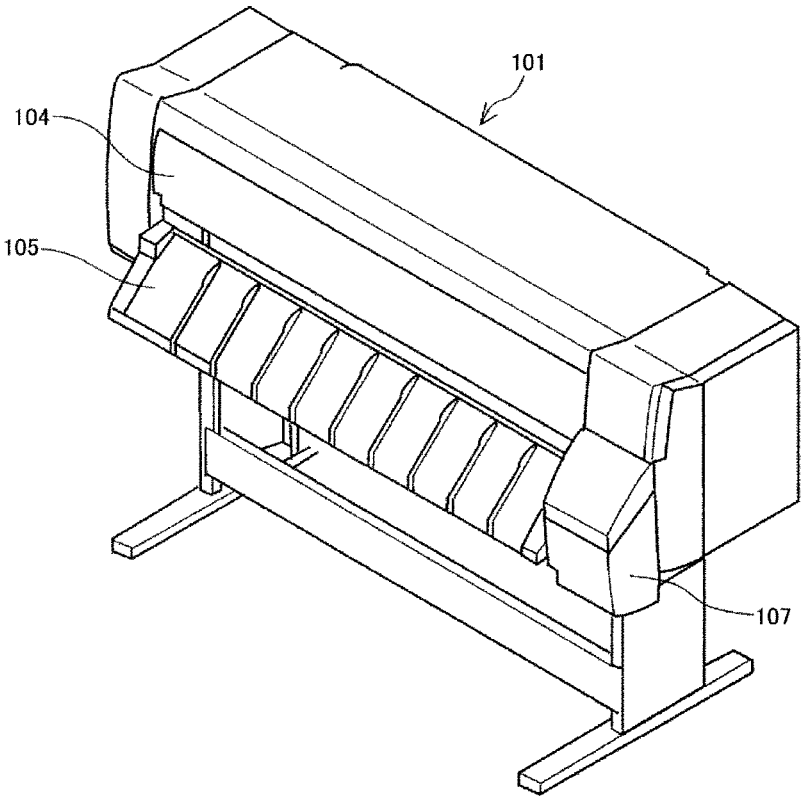
FIG. 1 is an external perspective view of an image forming apparatus according to an embodiment of the present invention.
Figure 2:
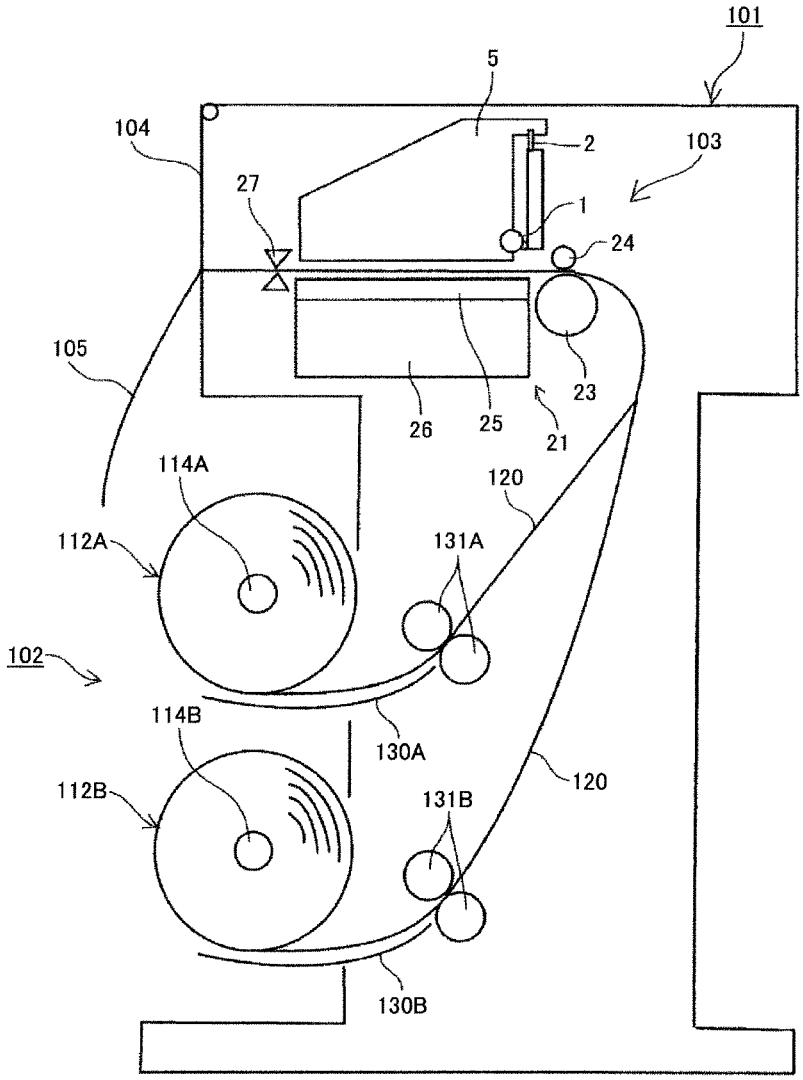
FIG. 2 is a schematic side view of the image forming apparatus.
Figure 3:
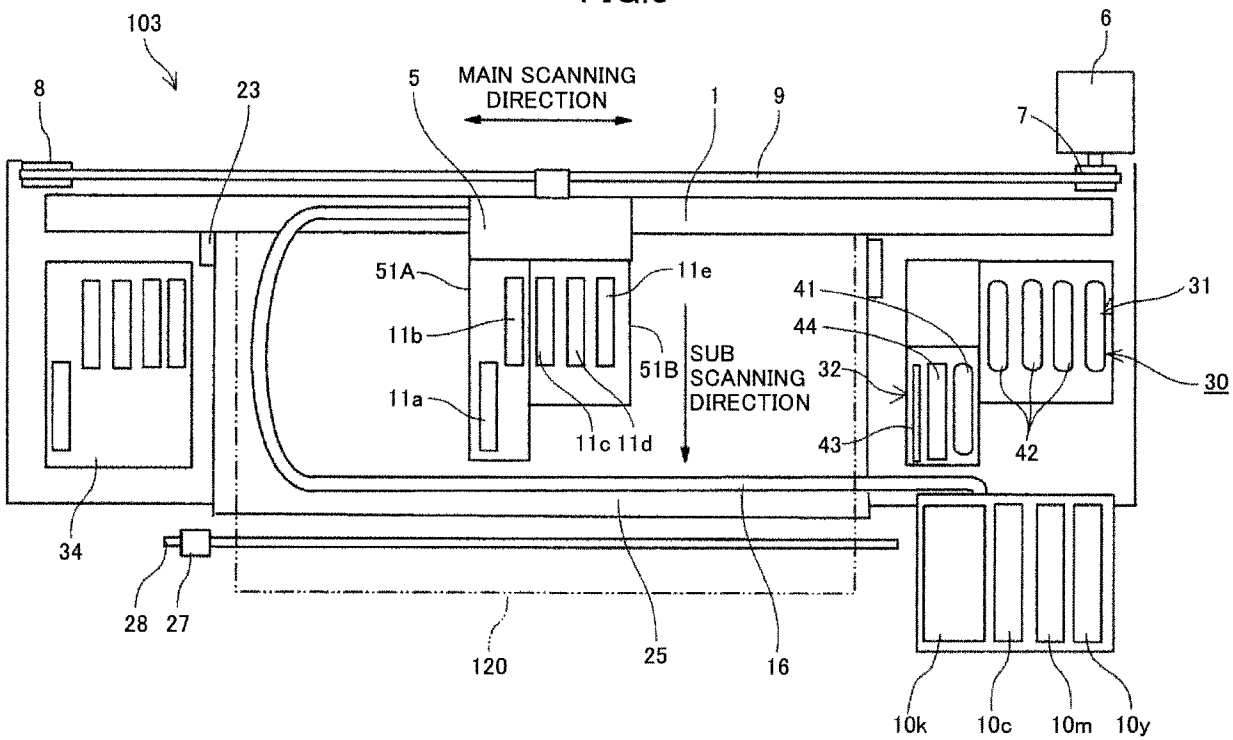
FIG. 3 is a plan view of relevant parts of a printing mechanism part in the image forming apparatus.

A description is given, with reference to the accompanying drawings, of embodiments of the present invention. An example of an image forming apparatus according to an embodiment of the present invention is described with reference to FIGS. 1 through 3. FIG. 1 is an external perspective view of the image forming apparatus, FIG. 2 is a schematic side view of the image forming apparatus, and FIG. 3 is a plan view of relevant parts of a printing mechanism part in the image forming apparatus.

The image forming apparatus is a serial type image forming apparatus, and includes an apparatus main body 101 and a sheet feeding device 102 disposed under the apparatus main body 101. Note that the sheet feeding device 102 is disposed under the apparatus main body 101 as a separate body from the apparatus main body 101; however, the sheet feeding device 102 may be provided to form a single body together with the apparatus main body 101, as illustrated in FIG. 2.

Inside the apparatus main body 101, there is disposed a printing mechanism part 103 for forming images on a roll paper 120 that is a roll type medium fed from the sheet feeding device 102.

Furthermore, on the front side of the apparatus main body 101 (the side from which the roll paper 120, on which images have been printed and which has been cut, is discharged), there is provided an open-close cover 104 that can be opened and closed for exposing the printing mechanism part 103 inside the apparatus main body 101. Furthermore, on the front side of the apparatus main body 101, there is provided a sheet discharge guide member 105 for guiding the roll paper 120 that is discharged.

As illustrated in FIG. 3, the printing mechanism part 103 has a guide rod 1 which is a guide member and a guide stay 2, which are bridged across both side plates (not shown). A carriage 5 is held by the guide rod 1 and the guide stay 2 so as to be movable in a main scanning direction (carriage moving direction) as viewed in FIG. 3.

The carriage 5 is moved by a main scanning motor 6, which is a driving source disposed on one side of the main scanning direction, via a driving pulley 7, a driven pulley 8, and a timing belt 9.

As illustrated in FIG. 3, in the carriage 5, a plurality of (five in this case) recording heads 11*a* through 11*e* (referred to as recording heads 11 when not distinguished; the same applies to other terms) are mounted. Each of the recording heads 11 is formed by combining a liquid jetting head and a head tank for supplying liquid to this liquid jetting head, as one body.

The plurality of recording heads 11 jet ink liquid droplets of the colors of, for example, black (K), yellow (Y), magenta (M), and cyan (C). Furthermore, in the recording heads 11, a nozzle row including a plurality of nozzles is arranged in a sub scanning direction orthogonal to the main scanning direction, which is fixed so that the droplet jetting direction is downward.

The recording head 11*a* is disposed so as to be displaced from the recording heads 11*b* through 11*e* by one head (by one nozzle row) in the sub scanning direction that is orthogonal to the main scanning direction. Furthermore, each of the recording heads 11*a* through 11*e* includes two nozzle rows. The recording heads 11*a* and 11*b* jet liquid droplets of the same black color, while the recording heads 11*c* through 11*e* jet liquid droplets of magenta (M), cyan (C), and yellow (Y), respectively.

Accordingly, to form a monochrome image, the recording heads 11*a* and 11*b* are used to perform one scanning operation (main scanning) having a width of two heads (printing width), and to form a color image, for example, the recording heads 11*b* through 11*e* are used.

That is to say, in the present embodiment, each of the recording heads 11*c* through 11*e* constitute a first recording head, while the two recording heads 11*a* and 11*b* constitute a second recording head having a wider printing width than the first recording head.

Note that the second recording head having a wide printing width for forming monochrome images may not be constituted by the two recording heads 11*a* and 11*b* as described above, but may be constituted by one head.

To the head tanks of the recording heads 11, ink of the respective colors is supplied from ink cartridges 10*k*, 10*c*, 10*m*, and 10*y* that are main tanks, via a supply tube 16. The ink cartridges 10 are attached to a cartridge attachment part 107 so as to be replaceable, which is provided at the front side of the apparatus main body 101 illustrated in FIG. 1. To the two recording heads 11*a* and 11*b* that jet liquid droplets of the same color, ink is supplied from a single ink cartridge 10*k*.

Meanwhile, in the main scanning area of the carriage 5, in the recording area, the roll paper 120 is fed from the sheet feeding device 102 described below, which is intermittently conveyed by a conveying unit 21 in a direction (sub scanning direction, sheet conveying direction) orthogonal to the main scanning direction of the carriage 5.

The conveying unit 21 includes a conveying roller 23 and a pressurizing roller 24 facing the conveying roller 23, which are for conveying the roll paper 120 that is a roll type medium fed from the sheet feeding device 102. Furthermore, as described below, the conveying unit 21 includes a conveying guide member 25, which is a guide member in which a plurality of recessed shape parts and suction holes are formed, and a suction mechanism part 26 for performing suctioning through the suction holes of the conveying guide member 25.

On the downstream side of the conveying unit 21, as shown in FIG. 2, there is disposed a cutter 27 acting as a cutting means for cutting the roll paper 120 on which an image has been formed by the recording heads 11, to a predetermined length.

The cutter 27 is attached to, for example, a wire or a timing belt 26. The timing belt 28 is wound around a driving pulley which is driven by a driving motor (not shown) and a driven pulley. By moving the timing belt 28 in a main scanning direction by the driving motor via the driving pulley, the roll paper 120 can be cut to a predetermined length by the cutter 27.

Furthermore, on one side of the main scanning direction of the carriage 5, a maintenance recovery mechanism 30 is disposed on the side of the conveying guide member 25, for performing maintenance and recovery on the recording heads 11. Furthermore, on the other side of the main scanning direction of the carriage 5, an idle jetting receiver 34 is disposed on the side of the conveying guide member 25, at which the recording heads 11 perform idle jetting by jetting liquid droplets that do not contribute to image forming.

The maintenance recovery mechanism 30 includes a first maintenance recovery unit 31 held by the frame member of the apparatus main body 101, and a second maintenance recovery unit 32 held by the frame member of the maintenance recovery mechanism 30 so as to reciprocate in the sub scanning direction. When performing maintenance and recovery on the recording head 11*a*, the second maintenance recovery unit 32 is at the position of FIG. 3, and when performing maintenance and recovery on the recording heads 11*b* through 11*e*, the second maintenance recovery unit 32 moves to the same sub scanning direction position as that of the first maintenance recovery unit 31.

The maintenance recovery mechanism 30 includes, for example, a suction cap 41 and moisture retention caps 42 for capping the nozzle surfaces of the recording heads 11 (the surface on which the nozzle is formed). Furthermore, the maintenance recovery mechanism 30 includes a wiper member 43 for wiping the nozzle surfaces and an idle jetting receiver 44 for receiving liquid droplets (idle jetting droplets) that do not contribute to image forming.

The sheet feeding device 102 includes roll bodies 112A, 112B at top and bottom stages (hereinafter, reference numerals of members of the top stage are accompanied by "A", and reference numerals of members of the bottom stage are accompanied by "B" for distinguishing the members of the top and bottom stages; the same applies to other members).

The roll body 112 is formed by winding a sheet 120 that is a long roll type medium (referred to as "roll paper" as described above) around a tube 114 that is a core member. The roll body is a generic term for a member formed by combining the tube 114 and the roll paper 120.

On the side of the apparatus main body 101, a guide member 130 for guiding the bottom face of the roll paper drawn out from the roll body 112 of the sheet feeding device 102, and a conveying roller pair 131 for causing the roll paper 120 to curve and for feeding the roll paper 120 upward, are disposed.

By rotating and driving the conveying roller pair 131, the roll paper 120 that is reeled out from the roll body 112 is conveyed in a state where the roll paper 120 is tensioned between the conveying roller pair 131 and the roll body 112. Then, the roil paper 120 is conveyed through the conveying roller pair 131 and is sent in between the conveying roller 23 and the pressurizing roller 24 of the conveying unit 21.

In the image forming apparatus having the above configuration, the carriage 5 moves in the main scanning direction, and the conveying unit 21 intermittently sends the roll paper 120 fed from the sheet feeding device 102. Then, the recording heads 11 are driven and caused to jet liquid droplets according to image information (print information), to form a desired image on the roll paper 120. After an image has been formed on the roll paper 120, the roll paper 120 is cut to a predetermined length by the cutter 27, guided to the sheet discharge guide member 105 on the front side of the apparatus main body 101, and is discharged.

Figure 4:
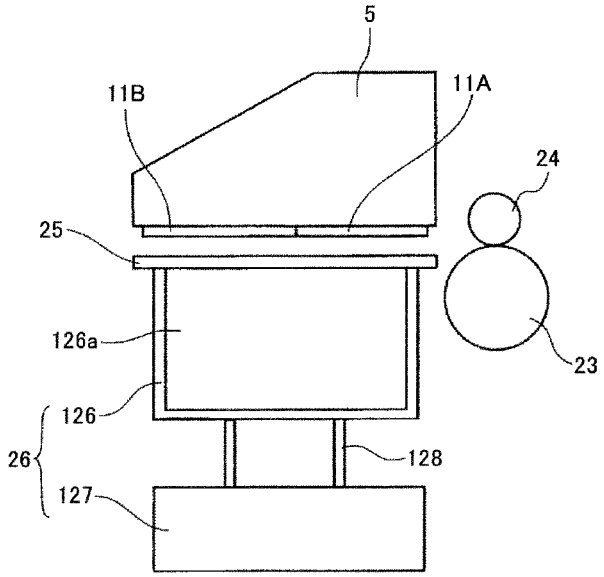
FIG. 4 is a side view for describing a first embodiment of the present invention.
Figure 5:
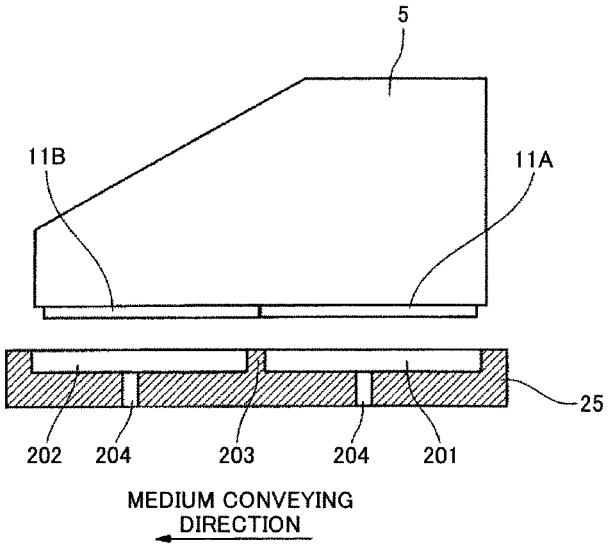
FIG. 5 is a side view of a cross-section of a conveying guide member of the first embodiment.
Figure 6:
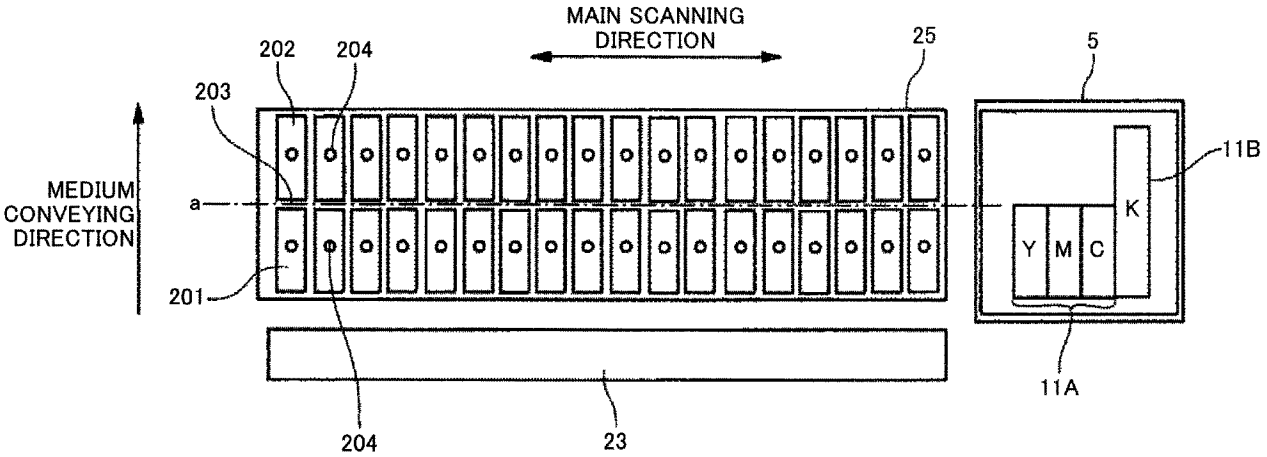
FIG. 6 is a plan view of the first embodiment.

Next, a first embodiment of the present invention is described with reference to FIGS. 4 through 6. FIG. 4 is a side view for describing the first embodiment, FIG. 5 is a side view of a cross-section of a conveying guide member of the first embodiment, and FIG. 6 is a plan view of the first embodiment.

Note that in the following, the above recording heads 11*a*, 11*b* used for monochrome printing are collectively expressed as a "second recording head 11B", and the recording heads 11*c* through 11*e* used for color printing are collectively expressed as a "first recording head 11A". However, as described above, the recording head 11*b* is also used for color printing.

On the opposite side (bottom side) to the recording heads 11 of the conveying guide member 25, there is disposed the suction mechanism part 26 as described above. The suction mechanism part 26 includes a suction room forming member 126 forming a suction room 126*a* and a suction fan 127 connected to the suction room 126*a* via connection paths 128.

In the conveying guide member 25, a plurality of recessed shape parts 201, 202 are formed, arranged in a sheet conveying direction (medium conveying direction) on the side (sheet guiding side) facing the recording heads 11.

"Arranged in a sheet conveying direction" does not need to mean "aligned" in the sheet conveying direction, as long as the recessed shape parts 202 are disposed on the downstream side in the sheet conveying direction of the recessed shape parts 201. Specifically, the recessed shape parts 201 and the recessed shape parts 202 adjacent to the recessed shape parts 201 may be displaced from each other in the movement direction of the carriage 5 orthogonal to the sheet conveying direction (for example, by half the arrangement pitch of the recessed shape parts 201).

In the recessed shape parts 201 and the recessed shape parts 202, suction holes 204 are formed, which are connected to the suction room 126*a*.

The recessed shape parts 201 and the recessed shape parts 202 are divided by a rib (partition wall part) 203 formed at a position a corresponding to the downstream edge in the sheet conveying direction of the first recording head 11A. That is to say, the conveying guide member 25 includes the partition wall part 203 between the recessed shape parts 201, 202, provided at a position corresponding to the downstream side edge in the medium conveying direction of the first recording head 11A.

Furthermore, there are a plurality of the recessed shape parts 201 and a plurality of the recessed shape parts 202 provided in the main scanning direction. The number of the recessed shape parts 201 and the number of the recessed shape parts 202 in the main scanning direction are not limited to the example illustrated in the figure, as long as there is one or more of each.

Figure 7A:
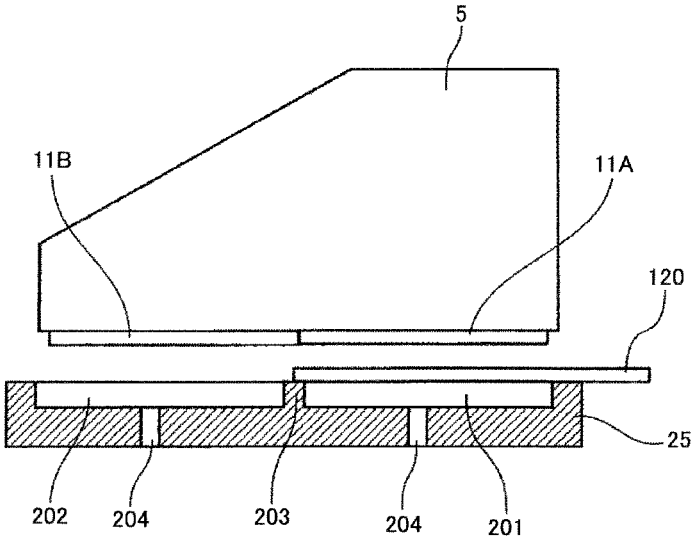
FIGS. 7A and 7B are side views used for describing the function of the first embodiment.
Figure 7B:
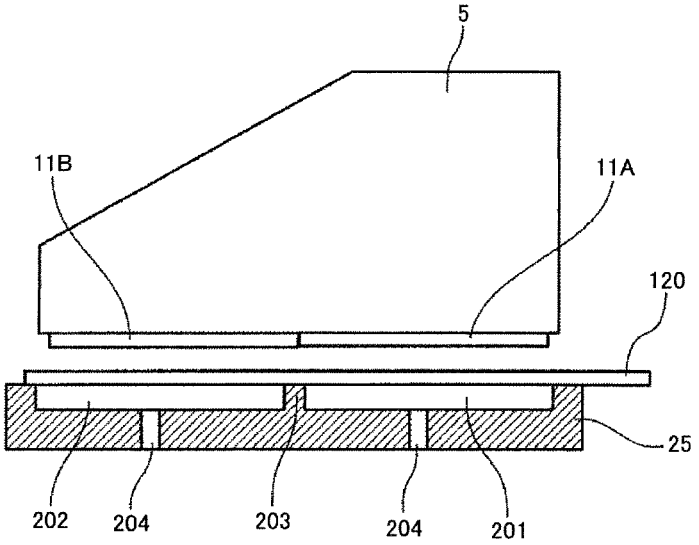

Next, a description is given of the function of the present embodiment having the above configuration, with reference to FIGS. 7A and 7B. FIGS. 7A and 7B are side views used for describing the function.

First, when the first recording head 11A is used to perform color printing by one path printing, as illustrated in FIG. 7A, the leading end of the roll paper 120 is conveyed to the position of the partition wall part 203, and printing is started.

Accordingly, when starting color printing, the recessed shape parts 201 on the upstream side are blocked by the roll paper 120, and therefore the recessed shape parts 201 are sealed, and a large suction force is applied.

In this case, it is preferable to separately provide the suction rooms 126*a* connected to the recessed shape parts 201 and the recessed shape parts 202 so that the suction force is controlled individually; however, the configuration may have only one suction room 126*a*. In this case, the recessed shape parts 202 are exposed and therefore air flows in through the suction holes 204 of the recessed shape parts 202 and the suction force relatively decreases; however, this flow-in amount is restricted by the diameter of the suction holes 204, and therefore the suction force of the recessed shape parts 201 is not lost. Furthermore, in order to adjust the suction force, the duty control of the suction fan 127 described below may be used.

Therefore, even if the revolution speed of the suction fan 127 is low (even if the suction force is small), the roll paper 120 can be suctioned to the surface of the conveying guide member 25, so that the roll paper 120 is prevented from floating.

Furthermore, when the second recording head 11B is used to perform monochrome printing by one path printing, as illustrated in FIG. 7B, the leading end of the roll paper 120 is conveyed to the position exceeding the recessed shape parts 202 on the downstream side, and printing is started.

Accordingly, when starting monochrome printing, the recessed shape parts 201 on the upstream side and the recessed shape parts 202 on the downstream side are both blocked by the roll paper 120, and therefore the recessed shape parts 201, 202 are sealed, and a large suction force is applied.

Therefore, even if the revolution speed of the suction fan 127 is low (even if the suction force is small), the roll paper 120 can be suctioned to the surface of the conveying guide member 25, so that the roll paper 120 is prevented from floating.

As described above, in the guide member, a plurality of recessed shape parts are formed which are arranged in at least the medium conveying direction, and at least some of the plurality of recessed shape parts are divided at the position corresponding to the downstream edge side in the medium conveying direction of the first recording head. Accordingly, even when recording heads having different printing widths are included, according to the printing width, an appropriate amount of suction force can be applied from the start of the printing, so that the sheet is prevented from floating.

Figure 8:
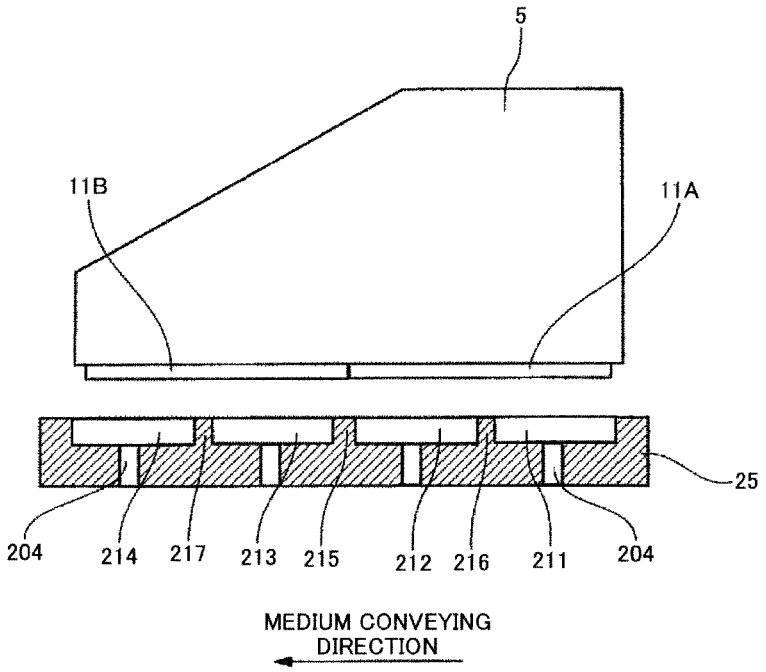
FIG. 8 is a side view of a cross-section of a conveying guide member of a second embodiment of the present invention.
Figure 9:
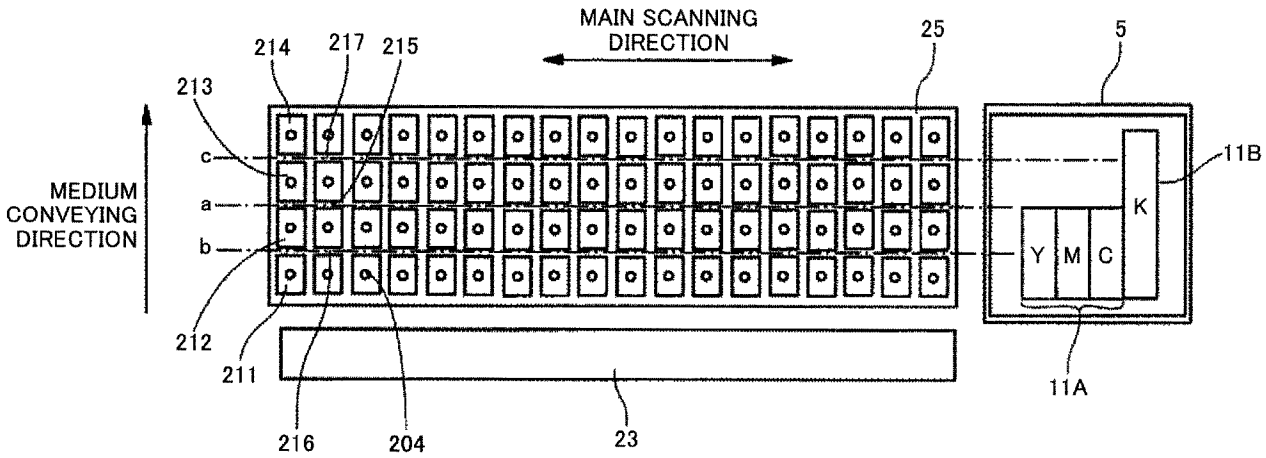
FIG. 9 is a plan view of the second embodiment.

Next, a second embodiment of the present invention is described with reference to FIGS. 8 and 9. FIG. 8 is a side view of a cross-section of a conveying guide member of the second embodiment, and FIG. 9 is a plan view of the second embodiment.

In the present embodiment, in the conveying guide member 25, a plurality of recessed shape parts 211 through 214 aligned in a row in the sheet conveying direction (medium conveying direction) are formed, on the side (sheet guiding side) facing the recording heads 11.

A partition wall part 215 between the recessed shape parts 212 and the recessed shape parts 213 is formed at a position a corresponding to the downstream edge in the sheet conveying direction of the first recording head 11A.

Furthermore, a partition wall part 216 between the recessed shape parts 211 and the recessed shape parts 212 is formed at a position b corresponding to the print start position when performing color printing by multi-path printing. In the present embodiment, the partition wall part 216 between the recessed shape parts 211 and the recessed shape parts 212 is at a position corresponding to the print start position when 16 path printing having the maximum number of multi paths is performed.

Furthermore, a partition well part 217 between the recessed shape parts 213 and the recessed shape parts 214 is formed at a position c corresponding to the print start position when performing monochrome printing by multi-path printing.

Note that in the present embodiment also, a plurality of each of the recessed shape parts 211 through 214 are provided in the main scanning direction. However, the number of each of the recessed shape parts 211 through 214 in the main scanning direction is not limited to the example illustrated in the figure, as long as there is one or more of each.

Next, a description is given of the function of the present embodiment having the above configuration, with reference to FIGS. 10A through 11B. FIGS. 10A through 11B are side views used for the description.

Figure 10A:
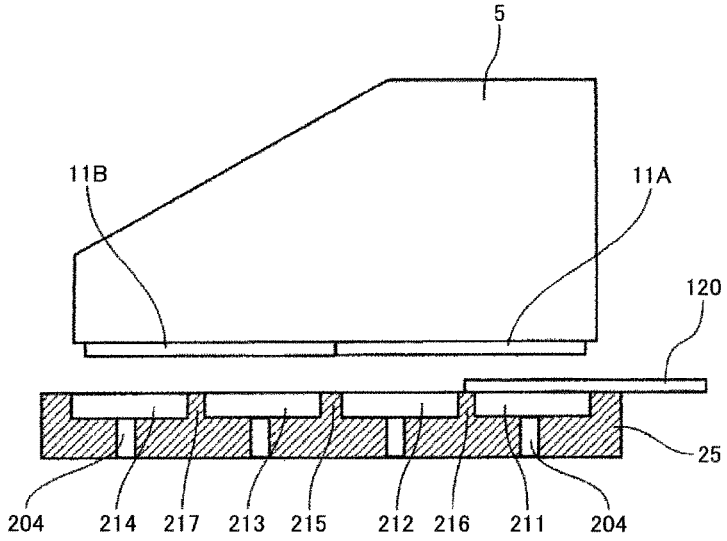
FIGS. 10A and 10B are side views used for describing of the function of the second embodiment.

First, when the first recording head 11A is used to perform color printing by multi-path printing, as illustrated in FIG. 10A, the leading end of the roll paper 120 is conveyed to the position of the partition wall part 216, and printing is started.

Figure 10B:
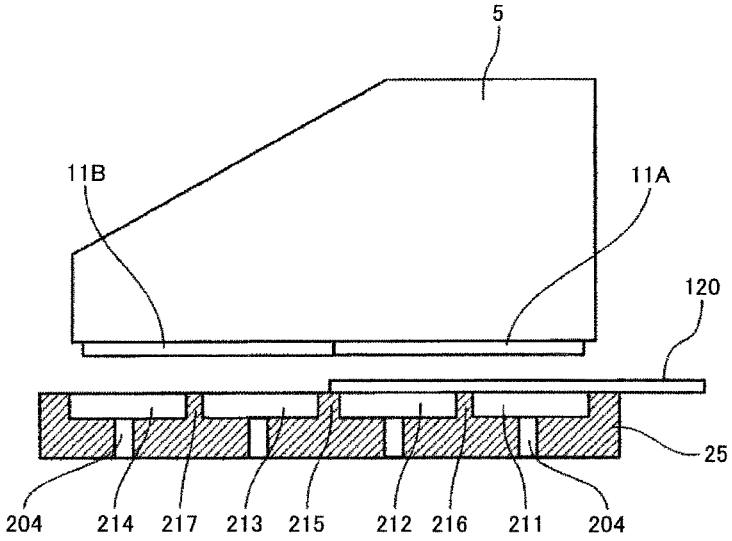

Furthermore, when the first recording head 11A is used to perform color printing by one path printing, as illustrated in FIG. 10B, the leading end of the roll paper 120 is conveyed to the position of the partition wall part 215, and printing is started.

Figure 11A:
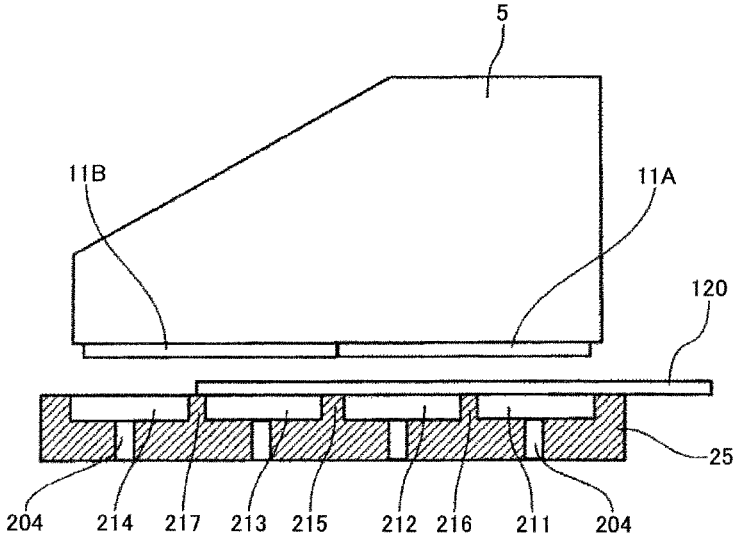
FIGS. 11A and 11B are side views used for describing of the function of the second embodiment.

Furthermore, when the second recording head 11B is used to perform monochrome printing by multi-path printing, as illustrated in FIG. 11A, the leading end of the roll paper 120 is conveyed to the position of the partition wall part 217, and printing is started.

Figure 11B:
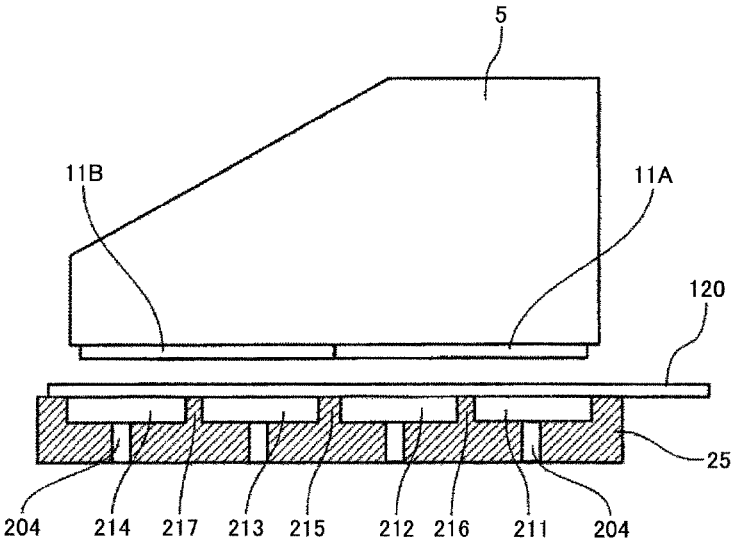

Furthermore, when the second recording head 11B is used to perform monochrome printing by one path printing, as illustrated in FIG. 11B, the leading end of the roll paper 120 is conveyed to the position exceeding the recessed shape parts 214, and printing is started.

In any case, among the recessed shape parts 211 through 214, the recessed shape parts, which are on the upstream side with respect to the leading end of the roll paper 120, are blocked by the roll paper 120, and therefore a large suction force is applied. Therefore, even if the revolution speed of the suction fan 127 is low (even if the suction force is small), the roll paper 120 can be suctioned to the surface of the conveying guide member 25, so that the roll paper 120 is prevented from floating.

As described above, the position of the partition wall parts 215 through 217 is the position corresponding to the downstream edge in the sheet conveying direction of the first recording head 11A, and the position corresponding to the print start position when performing multi-path printing. Accordingly, in any case, even if the revolution speed of the suction fan 127 is low, the roll paper 120 can be suctioned to the surface of the conveying guide member 25 from the print start time, so that the roll paper 120 is prevented from floating.

Figure 12:
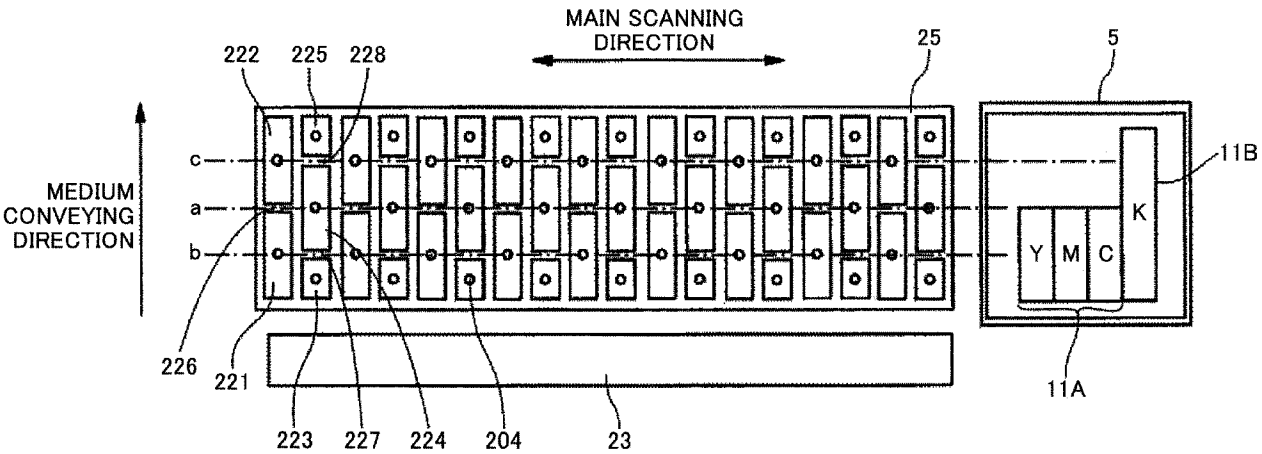
FIG. 12 is a plan view for describing of a third embodiment of the present invention.

Next, a third embodiment of the present invention is described with reference to FIG. 12. FIG. 12 is a plan view for describing of the third embodiment.

In the present embodiment, in the conveying guide member 25, rows of a plurality of recessed shape parts 221, 222 aligned in a row and rows of a plurality of recessed shape parts 223 through 225 aligned in a row in the sheet conveying direction (medium conveying direction) are formed, on the side (sheet guiding side) facing the recording heads 11.

In the main scanning direction, the rows of the recessed shape parts 221, 222 and the rows of the recessed shape parts 223 through 225 are alternately formed.

A partition wall part 226 between the recessed shape parts 221 and the recessed shape parts 222 is formed at a position a corresponding to the downstream edge in the sheet conveying direction of the first recording head 11A.

Furthermore, a partition wall part 227 between the recessed shape parts 223 and the recessed shape parts 234 is formed at a position b corresponding to the print start position when performing color printing by multi-path printing.

Furthermore, a partition wall part 228 between the recessed shape parts 224 and the recessed shape parts 235 is formed at a position c corresponding to the print start position when performing monochrome printing by multi-path printing.

By the above configuration, when performing color printing by multi-path printing with the first recording head 11A, the recessed shape parts 223 are blocked by the roll paper 120 when starting printing. Therefore, the recessed shape parts 223 are sealed, and a large suction force is applied.

Furthermore, when performing color printing by one path printing with the first recording head 11A, the recessed shape parts 221, 223 are blocked by the roll paper 120 when starting printing. Therefore, the recessed shape parts 221, 223 are sealed, and a large suction force is applied.

Furthermore, when performing monochrome printing by multi-path printing with the second recording head 11B, the recessed shape parts 221, 223, 224 are blocked by the roll paper 120 when starting printing. Therefore, the recessed shape parts 221, 223, 224 are sealed, and a large suction force is applied.

Furthermore, when performing monochrome printing by one path printing with the second recording head 11B, the recessed shape parts 221 through 225 are blocked by the roll paper 120 when starting printing. Therefore, the recessed shape parts 221 through 225 are sealed, and a large suction force is applied.

Accordingly, in any case, even if the revolution speed of the suction fan 127 is low, the roll paper 120 can be suctioned to the surface of the conveying guide member 25 from the start of the printing, so that the roll paper 120 is prevented from floating.

Figure 13:
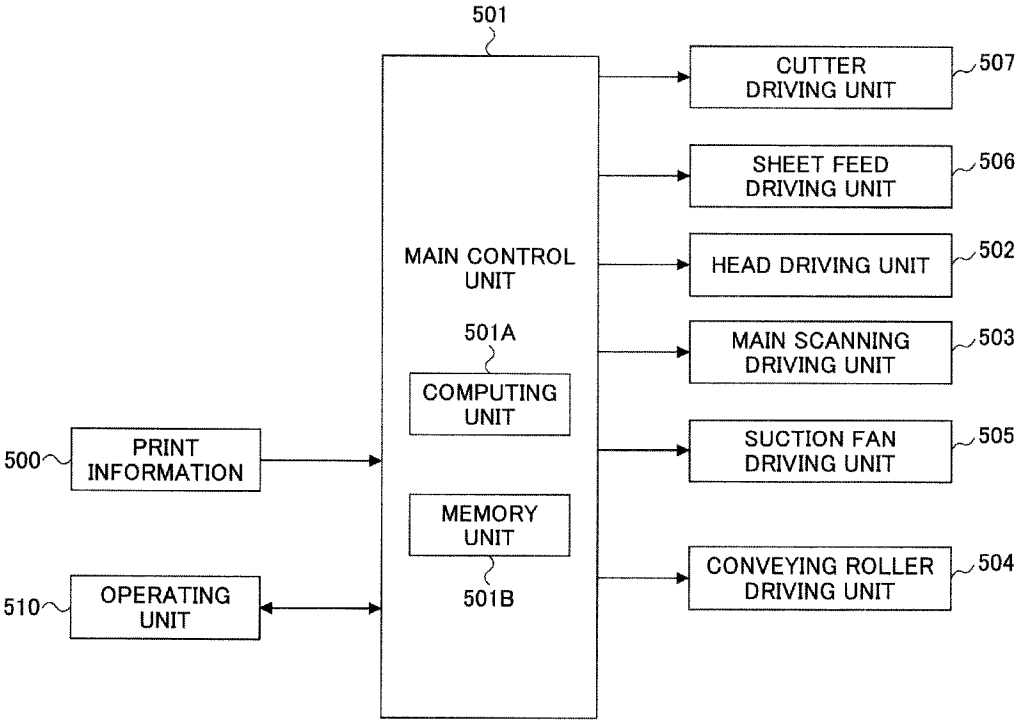
FIG. 13 is a block diagram for describing the overview of the control unit of the image forming apparatus.

Next, a description is given of the overview of the control unit of this image forming apparatus, with reference to the block diagram of FIG. 13.

A main control unit 501 is constituted by a microcomputer including a CPU, a ROM, a RAM, and an I/O, and includes a computing unit 501A constituted by a CPU, and a memory unit 501B constituted by a ROM and a RAM, and serves as a means for controlling the driving of the suction fan 127 that is a suction means.

The main control unit 501 inputs print information 500 provided from the host side. Then, in order to form an image according to the print information 500, the main control unit 501 drives the conveying roller pair 131 via a sheet feed driving unit 506, so that the roll paper 120 is fed (fed and conveyed) from the roll body 112 of the top stage or the bottom stage of the sheet feeding device 102.

Furthermore, the main control unit 501 controls the driving of the main scanning motor 6 via a main scanning driving unit 503 to move the carriage 5 in the main scanning direction. Furthermore, the main control unit 501 rotates the conveying roller 23 via a conveying roller driving unit 504, and drives the suction fan 127 via a suction fan driving unit 505, and moves the roll paper 120 in the sub scanning direction. Furthermore, the main control unit 501 controls the driving of the recording heads 11 via a head driving unit 502 according to the print information 500, and causes the recording heads 11 to jet required liquid droplets, to form a desired image on the roll paper 120.

Furthermore, the main control unit 501 drives the cutter 27 via a cutter driving unit 507, to cut the roll paper 120 on which image forming has bee completed to a desired length.

Furthermore, to the main control unit 501, an operating unit 510 is connected. From this operating unit 510, the type, etc., of the roll paper 120 can be input; however, the type of the roll paper 120 to be used can be input form the host side connected to the image forming apparatus.

Figure 14:
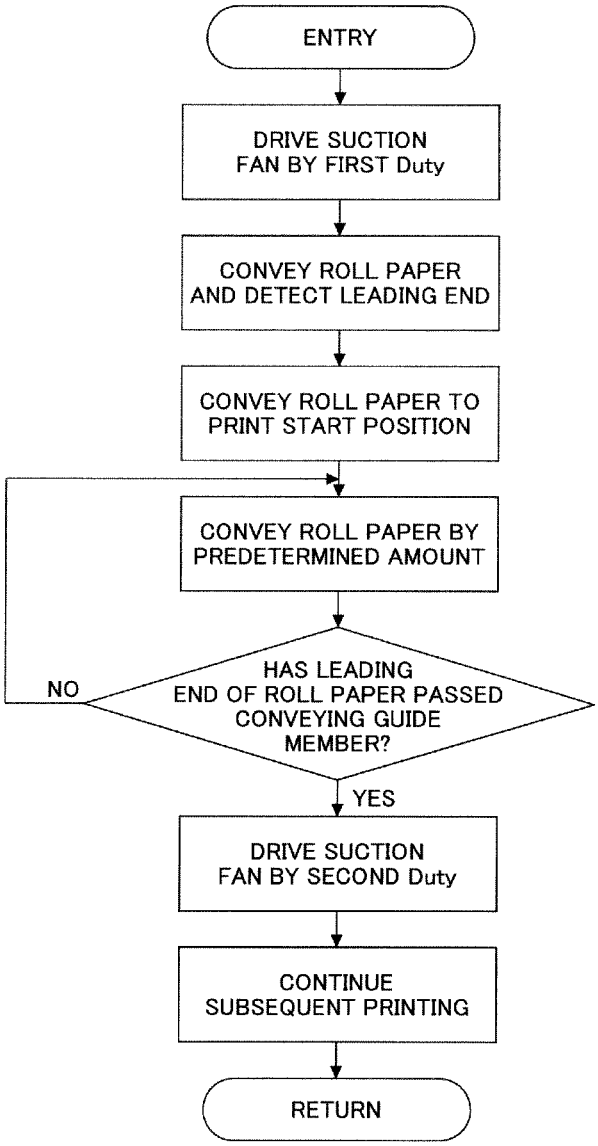
FIG. 14 is a flowchart for describing the drive control of a suction fan by the control unit.

Next, a description is given of the drive control of the suction fan 127 by the control unit, with reference to the flowchart of FIG. 14.

It is assumed that the suction fan 127 is driven by PWN control.

When the print information 500 is received, the control unit rotates the suction fan 127 by a first duty, for example, 50% duty. Then, the control unit drives the conveying roller 23 to convey the roll paper 120, and detects the leading end. Then, the control unit conveys the roll paper 120 to a print start position on the conveying guide member 25.

Then, the control unit performs printing by repeating the conveying and carriage scanning for printing, and when the leading end of the roll paper 120 passes the conveying guide member 25, the control unit rotates the suction fan 127 by a second duty, for example, 30% duty.

Then, the control unit continues printing.

Figure 15A:
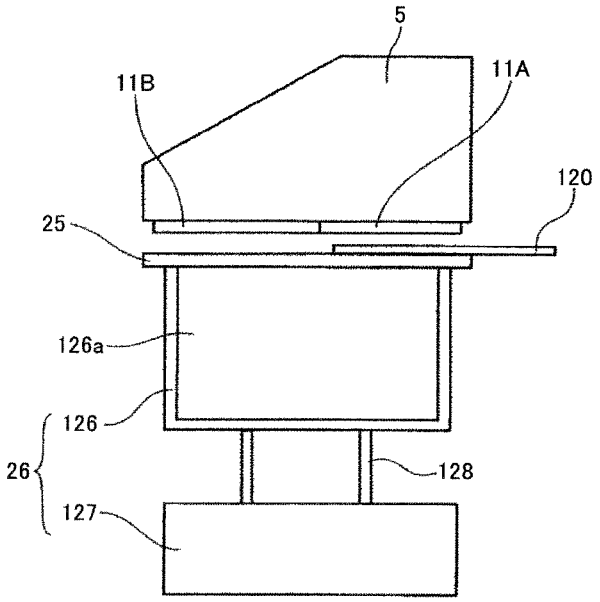
FIGS. 15A and 15B are side views for describing the drive control of the suction fan by the control unit.

That is to say, as shown in FIG. 15A, in an area where the suction force decreases because there are suction holes that are not blocked by the roll paper 120, the control unit increases the suction force of the suction fan 127, to maintain the suction force generated at the recessed shape parts 201 and prevent the leading end of the roll paper 120 from floating. Accordingly, a paper jam and image smearing can be avoided.

Figure 15B:
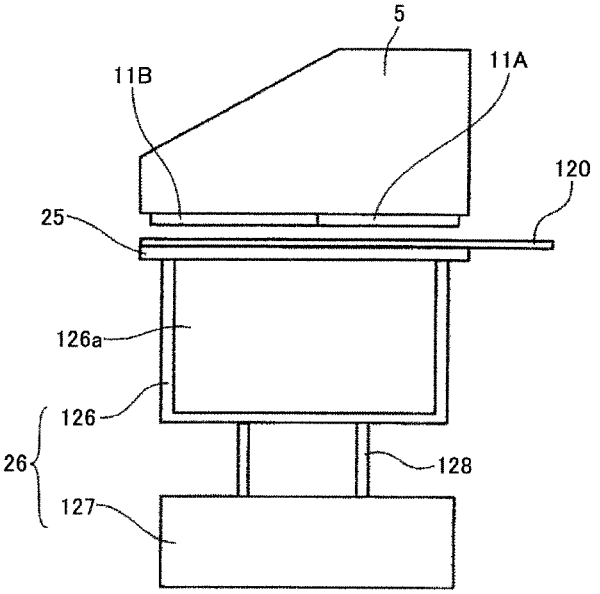

Furthermore, as shown in FIG. 15B, when all of the suction holes of the conveying guide member 25 are blocked, the suction force rises, and therefore the suction force of the suction fan 127 is decreased, so that the roll paper 120 is prevented from deforming due to an excessive suction force of the recessed shape parts 201, 202, and high quality images can be attained.

When the above control is applied to the embodiments described above, the suction force of the suction fan 127 is relatively increased until the leading end of the roll paper 120 reaches a predetermined partition wall part, and the suction force of the suction fan 127 is relatively decreased when the leading end of the roll paper 120 reaches the wall part corresponding to a print start position.

Note that in the present application, the material of a "sheet" is not limited paper, the sheet may be made of an OHP, cloth, glass, or a substrate; a sheet means sheets to which ink droplets and other liquid may adhere. Furthermore, the sheet includes a medium to be subjected to recording, a recording medium, recording paper, or a recording sheet. Furthermore, image forming, recording, printing, etc., are used as synonyms.

Furthermore, an "image forming apparatus" means an apparatus for forming images by jetting liquid onto media such as paper, threads, fiber, cloth, leather, metal, plastic, glass, timber, ceramics, etc. "Forming images" does not only mean to form images having meaning such as characters and figures onto media, but also means forming images without any meaning such as patterns onto media (simply jet liquid droplets onto media).

Furthermore, unless particularly limited, "ink" is not limited to ink per se, but ink is a collective term of all kinds of liquid with which images can be formed, including recording liquid, fixing-processing liquid, or liquid. Examples include a DNA sample, resist, a pattern material, or resin.

Furthermore, an "image" is not limited to a planar image; an image may be three-dimensionally formed on the sheet, or a three-dimensional object may be formed on the sheet.

Furthermore, unless particularly limited, the image forming apparatus may be a serial type image forming apparatus and a line type image forming apparatus.

Furthermore, in the above embodiments, an image forming apparatus using roll paper is described; however, the above embodiments are also applicable to an image forming apparatus using sheets.

According to one embodiment of the present invention, even when there are recording heads having different printing widths, an appropriate suction force is applied so that the sheet is prevented from floating.

The image forming apparatus is not limited to the specific embodiments described herein, and variations and modifications may be made without departing from the scope of the present invention.

The present application is based on and claims the benefit of priority of Japanese Priority Patent Application No. 2012-257999, filed on Nov. 26, 2012, the entire contents of which are hereby incorporated herein by reference.

What is claimed is:

1. An image forming apparatus comprising:

a carriage to mount a plurality of recording heads including nozzles for jetting liquid droplets and to move in a main scanning direction; and a conveying unit to convey a recording medium facing the plurality of recording heads in a sub scanning direction orthogonal to the main scanning direction, wherein the plurality of recording heads include a first recording head and a second recording head, and the second recording head has a printing width in the sub scanning direction wider than that if the first recording head, the first recording head is disposed so as to be displaced from the second recording head in the sub scanning direction so that a downstream side edge of the first recording head is arranged within the printing width of the second recording head in the sub scanning direction, the conveying unit includes a guide member configured to guide the recording medium facing the plurality of recording heads, a plurality of recessed shape parts arranged in at least a medium conveying direction are formed in the guide member, the recording medium can be suctioned by generating negative pressure at the plurality of recessed shape parts, and a partition wall part between the plurality of recessed shape parts is provided at a position corresponding to the downstream side edge of the first recording head in the sub scanning direction.

2. The image forming apparatus according to claim 1, wherein the guide member includes the partition wall part between the plurality of recessed shape parts provided at a position corresponding to a print start position when performing multi-path printing.

3. The image forming apparatus according to claim 1, further comprising:

a suction unit connected to the plurality of recessed shape parts of the guide member; and a control unit configured to drive and control the suction unit, wherein the control unit implements control of decreasing a suction force of the suction unit, when a leading end of the recording medium is positioned at the partition all part.

4. The image forming apparatus according to claim 1, wherein each recessed shape part amongst the plurality of recessed shape parts includes:

a floor surface inside the recessed shape part; and a suction hole formed in the floor surface.

5. The image forming apparatus according to claim 1, wherein the second recording head is disposed to be displaced from the first recording head in the main scanning direction.

* * * * *